US009914620B2

(12) United States Patent
Rui et al.

(10) Patent No.: US 9,914,620 B2
(45) Date of Patent: Mar. 13, 2018

(54) ABS BRAKE CONTROL CIRCUIT FOR ELEVATOR BRAKING

(71) Applicant: SHIJIAZHUANG WULONG BRAKE CORPORATION, Shijiazhuang (CN)

(72) Inventors: Zhenpu Rui, Shijiazhuang (CN); Wulin Han, Shijiazhuang (CN)

(73) Assignee: SHIJIAZHUANG WULONG BRAKE CORPORATION, Shijiazhuang, Hebei (CN)

( * ) Notice: Subject to any disclaimer, the term of this patent is extended or adjusted under 35 U.S.C. 154(b) by 543 days.

(21) Appl. No.: 14/606,761

(22) Filed: Jan. 27, 2015

(65) Prior Publication Data

US 2015/0136530 A1 May 21, 2015

Related U.S. Application Data

(63) Continuation of application No. PCT/CN2013/071341, filed on Feb. 4, 2013.

(30) Foreign Application Priority Data

Jul. 27, 2012 (CN) ..... 2012 1 0263124

(51) Int. Cl.

| | |
|---|---|
| ***B66B 1/32*** | (2006.01) |
| ***B66B 5/02*** | (2006.01) |
| ***B66B 5/00*** | (2006.01) |

(52) U.S. Cl.

CPC ..... *B66B 5/028* (2013.01); *B66B 1/32* (2013.01); *B66B 5/0031* (2013.01); *B66B 5/027* (2013.01)

(58) Field of Classification Search

CPC ..... B66B 5/028; B66B 1/32; B66B 5/0031; B66B 5/027

(Continued)

(56) References Cited

U.S. PATENT DOCUMENTS 4,506,766 A * 3/1985 Watanabe ..... B66B 5/027 187/290
5,070,290 A * 12/1991 Iwasa ..... H02P 23/06 187/288

(Continued)

FOREIGN PATENT DOCUMENTS

| | | |
|---|---|---|
| CN | 2151964 | 1/1994 |
| CN | 2675626 | 2/2005 |

(Continued)

*Primary Examiner* — Anthony Salata

(74) *Attorney, Agent, or Firm* — Hamre, Schumann, Mueller & Larson, P.C.

(57) ABSTRACT

An ABS brake control circuit for elevator breaking comprises a brake controller, a backup power supply, a manual rescue instruction circuit, a power grid power-off instruction circuit, a system failure instruction circuit, a signal identification circuit and a brake mode switching circuit. when transport equipments, such as an elevator, an escalator, and so on, encounters a system failure or power grid power-off or needs an emergency rescue, the ABS brake control circuit can allow the transport equipment to transition to a safe brake stop through a previous safe deceleration, thereby eliminating a significant security risk caused by a halt resulted from one-step brake which exists in an elevator brake system, and being capable of ensuring that the manual brake releasing will not cause the phenomena of a stalling of an elevator car and a brake failure of a brake, such that the brake safety of the transport equipments such as an elevator, an escalator, a moving walkway and the like is increased.

2 Claims, 1 Drawing Sheet

(58) Field of Classification Search
USPC ..... 187/247, 277, 288, 290, 293, 296, 297, 187/391, 393
See application file for complete search history.

(56) References Cited

U.S. PATENT DOCUMENTS 5,693,919 A * 12/1997 Sager ..... B66B 5/027 187/282
5,698,823 A * 12/1997 Tanahashi ..... B66B 1/30 187/290
5,969,303 A * 10/1999 Piserchia ..... B66B 1/28 187/288
6,056,088 A * 5/2000 Gerstenkorn ..... B66B 5/0031 187/390
6,802,395 B1 * 10/2004 Helstrom ..... B66B 5/02 187/247
7,677,362 B2 * 3/2010 Shimohata ..... B66B 5/18 187/277
7,896,136 B2 * 3/2011 Shibata ..... B66B 5/02 187/287
7,938,231 B2 * 5/2011 Ueda ..... B66B 5/02 187/288
8,297,411 B2 * 10/2012 Hashimoto ..... B66B 1/285 187/288
8,869,945 B2 * 10/2014 Harkonen ..... B66B 1/28 187/288
9,457,987 B2 * 10/2016 Della Porta ..... B66B 1/32

FOREIGN PATENT DOCUMENTS

| | | |
|---|---|---|
| CN | 102795524 | 11/2012 |
| CN | 202808257 | 3/2013 |
| JP | 10231080 | 9/1998 |
| JP | 2007-084177 | 4/2007 |

* cited by examiner

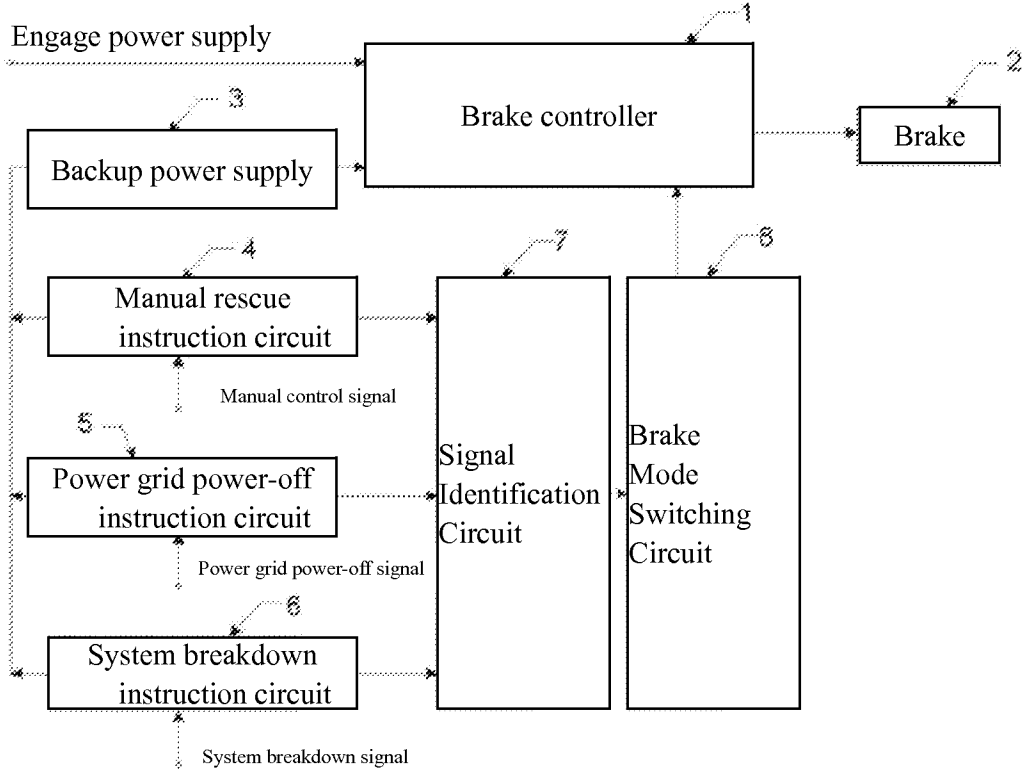
Engage power supply
1
Brake controller
2
Brake
3
Backup power supply
4
Manual rescue instruction circuit
Manual control signal
5
Power grid power-off instruction circuit
Power grid power-off signal
6
System breakdown instruction circuit
System breakdown signal
7
Signal Identification Circuit
8
Brake Mode Switching Circuit

ABS BRAKE CONTROL CIRCUIT FOR ELEVATOR BRAKING

TECHNICAL FIELD

The present application relates to a bake control circuit, in particular, to an ABS brake control circuit for elevator breaking.

BACKGROUND

With the development of the elevator technology, the usage of elevator transport equipments, such as vertical elevators, automatic escalators, automatic sidewalks, and the like, has become more and more popular and more and more widespread. Accordingly, the problem of how to realize a safety brake on various kinds of elevator carrying equipment has been gradually highlighted.

For vertical elevators, in normal situations, the brakes are breaking with zero speed after reaching the target floor, namely static brake; and when an abnormal condition occurs and an urgent brake is required, a breaking force which is too large or too small brake force can be dangerous to the person(s) in an elevator. A breaking force that is too large will make the car of the elevator decelerate too quickly, which may injure the person(s) in the car. A breaking force that is too small can't achieve the goal of safety brake, and may even cause serious accidents, such as that the elevator collapsing to the ground or hitting the ceiling. This is a widespread safety problem existing in elevator brake systems.

For escalators or sidewalks, when an abnormal situation happens and emergency breaking is needed, if the breaking force is too large, there is also a risk of causing the passenger(s) to fall, which can lead to injuries.

In addition, for an existing elevator without a machine room, when the elevator stops under abnormal conditions and while there are no people locked in the car, the rescue operation for manually releasing the break is extremely inconvenient. Due to the narrow stairway space, a worker can't operate the brake handle directly, and has to release the brake using a remote operating mode. Since corresponding mechanism components may have not been used in a long period of time, which can result in the problems with corrosion of mechanical transmission mechanism or a mechanical transmission device having a resistance that is too large, the remote operating mode may lead to a dangerous situation where the brake does not work again after the brake is released manually.

In view of this, when an elevator goes into an abnormal condition and emergency breaking is needed, it is practically important to realize a brake control system that can brake dynamically and effectively to safely decelerate the elevator carrying equipment, and a control mechanism with a reliable manual brake release measure in an emergency is also essential. But unfortunately, up to now, the elevator industry has not developed such a brake control system or control mechanism. Thus, the above-mentioned significant security risk exists in elevator brake systems has not been eliminated and solved.

SUMMARY

The present application aims to provide an ABS brake control circuit for elevator breaking, which changes the working mode of static brake and one-step stop of elevator brake systems through effective dynamic brake, and thereby solves the problem that the manual brake release rescue measure is not safe and reliable enough, such that the brake safety of transport equipments, such as elevators, escalators, sidewalks, and the like, is increased.

The present application is implemented by an ABS brake control circuit for elevator breaking, which comprises:

a brake controller, having an input terminal connected to a system working power supply and a backup power supply respectively and a control terminal connected to a brake mode switching circuit, and is configured to output a normal brake control signal to a brake under normal working conditions and output an ABS brake control signal to the brake under abnormal working conditions;

a backup power supply, having an input terminal connected to a power grid power-off instruction circuit and a system failure instruction circuit respectively and an output terminal connected to the brake controller, and is configured to provide a system brake working power supply under abnormal working conditions;

a power grid power-off instruction circuit, having an input terminal which is configured to receive a power grid power-off signal and an output terminal connected to the backup power supply and an signal identification circuit respectively, and is configured to switch power supplies for the brake controller automatically after receiving a power grid power-off signal and simultaneously output an instruction signal indicating that the system is in a power grid power-off state to a signal identification circuit;

a system failure instruction circuit, having an input terminal which is configured to receive a system failure signal and an output terminal connected to the backup power supply and the signal identification circuit respectively, and is configured to switch the power supplies for the brake controller automatically after receiving the system failure signal and simultaneously output an instruction signal indicating that the system is in a failure state to a signal identification circuit;

a signal identification circuit, having an input terminal connected to the power grid power-off instruction circuit and the system failure instruction circuit respectively, and an output terminal connected to a brake mode switching circuit, and is configured to identify a received input signal indicating that the system is under an abnormal working condition and output an instruction signal indicating that the system is certainly under an abnormal condition to a brake mode switching circuit; and a brake mode switching circuit, having an input terminal connected to the signal identification circuit and an output terminal connected to the brake controller, and is configured to switch anti-lock brake control under a normal working condition and an abnormal working condition and output a corresponding anti-lock brake control signal to the brake controller according to a determined type of the abnormal working condition.

The ABS brake control circuit for elevator breaking of the present invention further comprises:

a manual rescue instruction circuit, having an input terminal configured to receive a manual intervention control signal and an output terminal connected to the backup power supply and the signal identification circuit respectively, and is configured to switch power supplies for the brake controller automatically after receiving a manual intervention control signal and simultaneously output an instruction signal indicating that the system is in a manual intervention state to the signal identification circuit.

The ABS working mode of the present application specifically means that during the breaking process, a number of successive short-term power-on and power-off operations are applied on the brake, such that the brake is repeatedly engaged and released several times in a short time, thereby achieving the anti-lock brake with flexible inching brake, so that the brake with a slow deceleration and gradual stop is achieved. The one-step stop brake working mode of conventional brakes is changed. Therefore, an ABS brake process is essentially a dynamic stop brake process, though the rapid and repeated brake-releasing and brake-engaging actions, the brake object is slowed down gradually and finally stopped safely, and the purpose of the anti-lock brake is achieved.

By changing the working cycle of repeated brake-releasing and brake-engaging, the brake distance and dynamic brake force of the brake object can be changed correspondingly, and thus the deceleration of the brake object can be controlled. The repeated working frequency in the present application could be 1-10 times per second.

By using the ABS brake control circuit of the present application, when transport equipment, such as an elevator, an escalator, and so on, encounters a system failure or power grid power-off or needs an emergency rescue, the transport equipment can realize a brake working process that transits from safe deceleration to safe brake stop by using the anti-lock brake mode, which eliminates the significant security risk caused by the one-step stop brake which exists in elevator brake systems, and can ensure that artificial intervention and the usage of manual brake release will not cause a phenomena of stalling of an elevator car and failures of a brake, such that the brake safety of the transport equipment, such as an elevator, an escalator, a moving sidewalks, and so on, is greatly improved.

The present application is mainly applied to emergency brake and emergency rescue of transport equipments such as vertical elevators, escalators, automatic sidewalks and so on, which works safely and reliably, can avoid loss of lives, and is suitable for popularization.

BRIEF DESCRIPTION OF THE DRAWINGS

FIG. 1 is a circuit principle diagram of the present application.

DETAILED DESCRIPTION

As shown in FIG. 1, an ABS brake control circuit for elevator breaking of the present application comprises a brake controller 1, a backup power supply 3, a manual rescue instruction circuit 4, a power grid power-off instruction circuit 5, a system failure instruction circuit 6, a signal identification circuit 7, and a brake mode switching circuit 8.

An input terminal of the brake controller 1 is connected to a system working power supply and the backup power supply 3 respectively, and a control terminal of the brake controller 1 is connected to the brake mode switching circuit 8, and an output terminal of the brake controller 1 is connected to an object to be controlled, i.e., a brake 2. Under normal working conditions, the system working power supply provides power; and under abnormal working conditions, the power supply is automatically switched to the backup power supply 3. The brake controller 1 can output a normal brake signal under the normal working conditions, and output an anti-lock brake signal under abnormal working conditions.

An input terminal of the backup power supply 3 is connected to the manual rescue instruction circuit 4, the power grid power-off instruction circuit 5, and the system failure instruction circuit 6 respectively, and an output terminal of the backup power supply 3 is connected to the brake controller 1. The backup power supply 3 is configured to provide the brake work power supply to the brake system under abnormal working conditions.

An input terminal of the manual rescue instruction circuit 4 can be connected to a manual rescue operation button to receive a manual intervention control signal; and an output signal of the manual rescue instruction circuit 4 is connected to the backup power supply 3 and the signal identification circuit 7 respectively. Before manual rescue, the system working power supply has been disconnected, and the backup power supply 3 is standby. When the manual rescue operation button is pressed down, the backup power supply 3 provides power to the brake controller 1, and simultaneously sends an instruction to the signal identification circuit 7. During the hold time of the pressed down button, the anti-lock brake control is performed continually to make the car of the elevator move slowly step by step until the car reaches a preset position. Once the manual intervention control signal is withdrawn, the brake system automatically returns to a normal working state.

An input terminal of the power grid power-off instruction circuit 5 can be connected to a grid power supply monitoring circuit to receive a power grid power-off signal; an output terminal of the power grid power-off instruction circuit 5 is connected to the backup power supply 3 and the signal identification circuit 7 respectively. In this way, the power supply situation of the power grid may be monitored. When the power grid power-off is detected, the input power supply for the brake controller 1 is switched automatically, the brake controller 1 is connected to the backup power supply 3, and an instruction is sent to the signal identification circuit 7 to achieve the anti-lock brake function in a time preset by the system. When the power grid provides power again, the backup power supply 3 is disconnected automatically, and the system returns to a normal working state.

An input terminal of the system failure instruction circuit 6 can be connected to a system failure signal output terminal of the elevator brake control system to receive a system failure signal, and an output terminal of the system failure instruction circuit 6 is connected to the backup power supply 3 and the signal identification circuit 7 respectively. When the system failure signal appears, the input power for the brake controller 1 is switched automatically, and an instruction is sent to the signal identification circuit 7 to achieve the anti-lock brake function in a time preset by the system; after the preset time has passed, the system returns to the normal working state.

An input terminal of the signal identification circuit 7 is connected to the manual rescue instruction circuit 4, the power grid power-off instruction circuit 5, and the system failure instruction circuit 6 respectively, and an output terminal of the signal identification circuit 7 is connected to the brake mode switching circuit 8. The signal identification circuit 7 is configured to identify three kinds of abnormal working condition signals and send corresponding instruction signals indicating that the system is in abnormal working conditions to the brake mode switching circuit 8.

An input terminal of the brake mode switching circuit 8 is connected to the signal identification circuit 7, and an output terminal of the brake mode switching circuit 8 is connected to the brake controller 1. Under the control of the signal identification circuit 7, the normal brake and the anti-lock brake under abnormal working conditions are switched automatically. Under the normal working conditions, the brake mode switching circuit 8 is suspended automatically, and the brake controller 1 drives the brake 2 according to the normal working mode. Under the abnormal working conditions, the brake mode switching circuit 8 sends an anti-lock brake control signal to make the brake controller 1 drive the brake 2 according to an ABS working mode.

The working process of the brake control circuit of the present application is as follows:

I: Normal brake mode. When the power grid provides power normally, the system has no failure signal and no manual intervention control signal, the brake control circuit of the present application is in a normal work state. At this time, the signal identification circuit 7 has no output, the brake mode switching circuit 8 is suspended automatically and does not work, the brake controller 1 sends a driving signal for normal brake to the brake 2 under the control of the system working power supply, and the brake 2 is released and engaged under the control of the brake circuit.

II: Abnormal brake mode. When power grid is suddenly power-off or a system failure causes abnormal shutdown, the power grid power-off instruction circuit 5 or the system failure instruction circuit 6 starts to work correspondingly; on one hand, the backup power supply 3 is controlled to work and supply power to the brake controller 1; and on the other hand, the state identification is performed by the signal identification circuit 7, and the brake mode is switched by the brake mode switching circuit 8. In this work mode, the brake mode switching circuit 8 enables the brake controller 1 to achieve anti-lock brake in a preset time interval. When the preset time interval has passed, the brake mode switching circuit 8 is suspended automatically, and the backup power supply 3 is disconnected from the brake controller 1, such that the brake 2 is in a normal power-off brake state. After the power grid is power-on again or the system failure signal is withdrawn, the brake system returns to the normal working state.

III: Manual rescue mode. When the elevator is in an abnormal working condition and person(s) is/are imprisoned in the car, manual intervention is needed for emergency rescue. At this time, under the action of the manual intervention control signal, the manual rescue instruction circuit 4 starts to work; on one hand, the backup power supply 3 is controlled to work and supply power to the brake controller 1; and on the other hand, the state identification is performed by the signal identification circuit 7, and the brake mode is switched by the brake mode switching circuit 8. In this working mode, the brake mode switching circuit 8 makes the brake controller 1 be in the ABS brake mode during the hold time when the manual rescue operation button is pressed down, until the elevator car reaches a preset position and the manual intervention control signal is withdrawn, the brake mode switching circuit 8 stops output. After the manual intervention control signal is withdrawn, the brake controller 1 automatically returns to the normal brake working mode.

The parameters of the control circuit of the present application are as follows:

Engage power supply: 220V AC or 110V AC power supply;

Backup power supply: UPS power supply of 500-1000 VA, whose output voltage must be the same as that of the engage power supply.

ABS working frequency: 1-10 Hz/S

Auto ABS working time: 5-60 seconds (may be set in advance)

What is claimed is:

1. An ABS brake control circuit for elevator breaking, the ABS brake control circuit comprising:

a brake controller having an input terminal and a control terminal, the input terminal being connected to a system working power supply and a backup power supply respectively, the control terminal being connected to a brake mode switching circuit, and the brake controller being configured to output a normal brake control signal to a brake under normal working conditions and output an ABS brake control signal to the brake under abnormal working conditions;

a backup power supply having an input terminal and an output terminal, the input terminal being connected to a power grid power-off instruction circuit and a system failure instruction circuit respectively, the output terminal being connected to the brake controller, and the backup power supply being configured to provide a system brake working power supply under abnormal working conditions;

a power grid power-off instruction circuit having an input terminal and an output terminal, the input terminal being configured to receive a power grid power-off signal, the output terminal being connected to the backup power supply and a signal identification circuit respectively, and the power grid power-off instruction circuit being configured to, simultaneously, switch the power supplies for the brake controller automatically after receiving the power grid power-off signal and output an instruction signal indicating that the system is in a power grid power-off state to the signal identification circuit;

a system failure instruction circuit having an input terminal and an outpour terminal, the input terminal being configured to receive a system failure signal, the output terminal being connected to the backup power supply and the signal identification circuit respectively, and the system failure instruction circuit being configured to, simultaneously, switch the power supplies for the brake controller automatically after receiving the system failure signal and output an instruction signal indicating that the system is in a failure state to the signal identification circuit;

the signal identification circuit having an input terminal and an output terminal, the input terminal being connected to the power grid power-off instruction circuit and the system failure instruction circuit respectively, the output terminal being connected to the brake mode switching circuit, and the signal identification circuit being configured to identify a received input signal indicating that the system is under an abnormal working condition and output an instruction signal indicating that the system is certainly under an abnormal condition to the brake mode switching circuit; and the brake mode switching circuit having an input terminal and an output terminal, the input terminal being connected to the signal identification circuit, the output terminal being connected to the brake controller, and the brake mode switching circuit being configured to switch an anti-lock brake control and output a corresponding anti-lock brake control signal to the brake controller according to a determined type of the abnormal working condition.

2. The ABS brake control circuit for elevator braking of claim 1, the ABS brake control circuit further comprising:

a manual rescue instruction circuit having an input terminal and an output terminal, the input terminal being configured to receive a manual intervention control signal, the output terminal being connected to the backup power supply and the signal identification circuit respectively, and the manual rescue instruction circuit being configured to, simultaneously, switch the power supplies for the brake controller automatically after receiving the manual intervention control signal and output an instruction signal that indicates that the system is in a manual intervention state to the signal identification circuit.

* * * * *